United States Patent [19]

Kalenian

[11] 3,961,431

[45] June 8, 1976

[54] LUGGAGE TAG

[75] Inventor: Robert E. Kalenian, Chicago, Ill.

[73] Assignee: Conversion Caddy Co., Skokie, Ill.

[22] Filed: Sept. 22, 1975

[21] Appl. No.: 615,799

[52] U.S. Cl. ..... 40/21 R; 40/2 R

[51] Int. Cl.[2] ..... G09F 3/14

[58] Field of Search..... 40/2 R, 2 A, 308, 310, 40/312, 316, 317, 318, 322, 325, 10 R, 10 C, 20 R, 21 R, 21 C

[56] References Cited

UNITED STATES PATENTS

| | | | |
|---|---|---|---|
| 3,279,107 | 10/1966 | Baumgartner | 40/21 C |
| 3,352,040 | 11/1967 | Javkin | 40/21 R |
| 3,384,984 | 5/1968 | Field | 40/21 R |

*Primary Examiner*—Louis G. Mancene
*Assistant Examiner*—John H. Wolff
*Attorney, Agent, or Firm*—Paul Shapiro

[57] ABSTRACT

A luggage tag comprised of a unitary plastic member, including a strap for fastening the tag to the luggage. A case, having channelled internal sidewalls is attached to one end of the strap and is adapted to receive an identification label. A plate is attached to the other end of the strap and is adapted for sliding in the sidewall channels to effect closure of the case and the confinement of the label therein. The case is further provided with an aperture in the section of the case attached to the strap. When closing the case, the plate is passed through the aperture and gains entry to the sidewall channels by way of grooves formed in the surfaces of the sidewalls whereby the strap attached to the plate is bent to form a loop for fastening the tag to a piece of luggage.

4 Claims, 5 Drawing Figures

LUGGAGE TAG

BACKGROUND OF THE INVENTION

1. Field of the Invention

This invention relates to an identification tag, or more particularly, to a tag adapted to be attached to the handle or other suitable portions of handles of various articles of luggage such as valises, suitcases, handbags and the like, without requiring any additional means of connection.

2. The Prior Art

There is a recognized need for an improved means of identifying the passenger baggage which is carried by the airlines. Although this need is not confined to the air travel industry alone, the baggage problem faced by the airlines is a particularly difficult one. The passenger is necessarily separated from his heavy baggage because there is no room for it in the passenger cabin of the aircraft. Instead, heavy items must be stored below the passenger compartment, i.e., in the baggage hold of the aircraft. Then any mistake which the airline may make after taking custody of the passenger's baggage is indeed a serious one, because of the great distances routinely travelled by airplanes. These reflections are borne out by recent items in the press, concerning surveys which have shown lost luggage to be the principal service complaint of airline passengers.

The identification tags presently in use by the airlines are generally made of paper which may be easily torn and detached from the passenger's luggage, thereby destroying the identification. There is thus an obvious need for a better, more reliable baggage label for identifying passenger luggage for airline use which can be produced at low unit cost yet function effectively as a permanent means of identification.

Low-cost luggage tags of one piece construction molded from flexible plastic material have been utilized by the airlines for baggage identification. These tags are generally comprised of an elongated strip of synthetic plastic material having plate and strap portions. The strap is integrally molded with and connects with the plate at one end. The free end of the strap is provided with means for interlocking with an opening of suitable shape on the plate. A label, identifying the airline passenger is adhesively secured to the plate. In attaching the tag to a baggage handle, the strap is bent over the handle and inserted into the plate opening, locking the strap therein and forming a loop which encompasses the handle and is thereby secured thereto.

One disadvantage of luggage tags of the type just described is that there is no way in which to conceal the inscription on the label, and many passengers object to having their identities openly revealed to the public on these tags.

An object of this invention is the provision of a luggage tag of simple economical construction which is molded from plastic and is adapted to be looped around the handle of a piece of luggage or other anchoring means for attachment thereto.

A further object of this invention is the provision of a tag which, when attached to the handle of a piece of luggage, is provided with pocket means whereby an identifying label can be inserted and secured therein without exposing the name of the baggage owner to public scrutiny.

Still further objects of the present invention reside in the provision of a luggage tag that is highly attractive in appearance, that is strong and durable and capable of being inexpensively manufactured out of readily available synthetic plastic materials so as to permit wide use and distribution.

The above stated and other objects and advantages of the invention will become apparent from the following description when taken with the accompanying drawings. It will be understood, however, that the drawings are for purposes of illustration and are not to be construed as defining the scope or limits of the invention, reference being had for the latter purpose to the claims appended hereto.

BRIEF DESCRIPTION OF THE DRAWINGS

In the drawings wherein like reference characters denote like parts in the several views.

Referring now to FIG. 1, the tag 10 is molded from a flexible, resilient, strong, transparent or translucent synthetic resinous material such as low density polyethylene, high density polyethylene and polypropylene to form case portion 11, closure plate 12, both optimally of rectangular form, and a thin longitudinally elongated strap portion 13, connecting case 11 and plate 12 and integral therewith.

Figure 1:
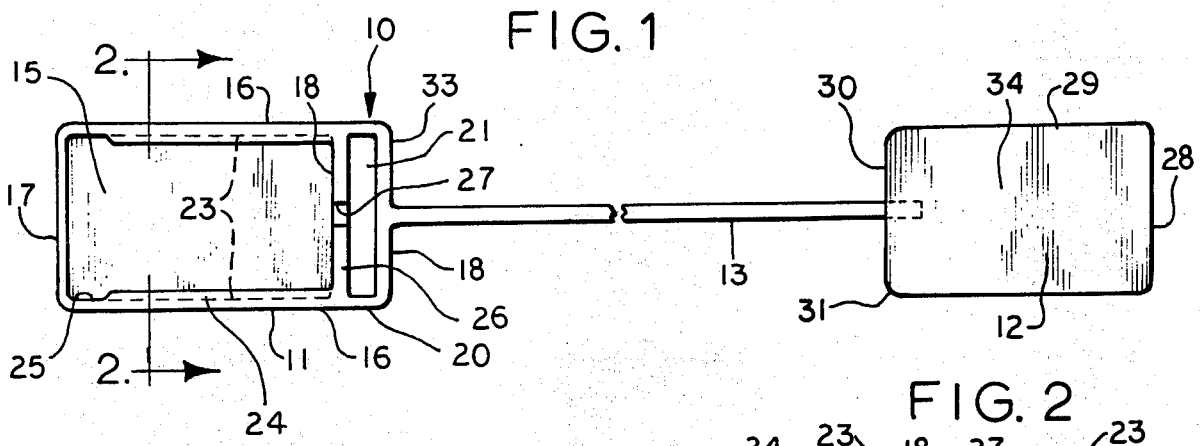
FIG. 1 is a plan view showing a luggage tag made in accordance with this invention, and in the flat condition.
Figure 2:
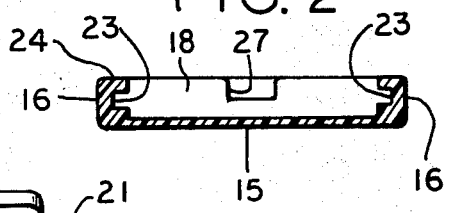
FIG. 2 is a vertical cross-section taken on the line 2—2 of FIG. 1.
Figure 3:
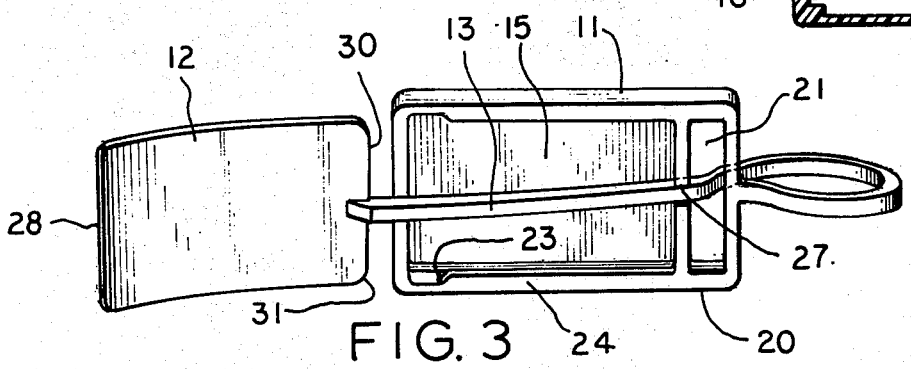
FIG. 3 is a perspective view showing the tag before the plate portion thereof is inserted into the channelled sidewalls of the case.
Figure 4:
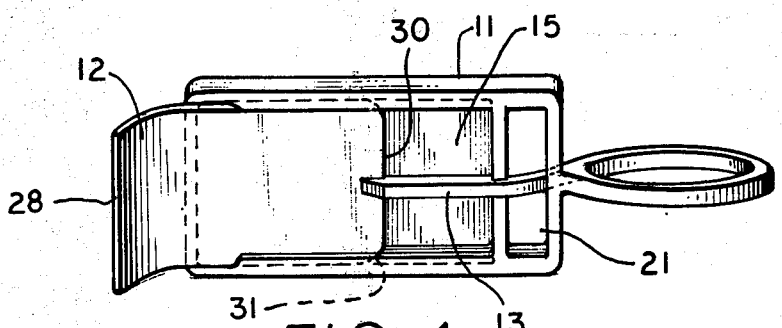
FIG. 4 is also a perspective view showing the plate partially inserted in the channelled sidewalls of the case.
Figure 5:
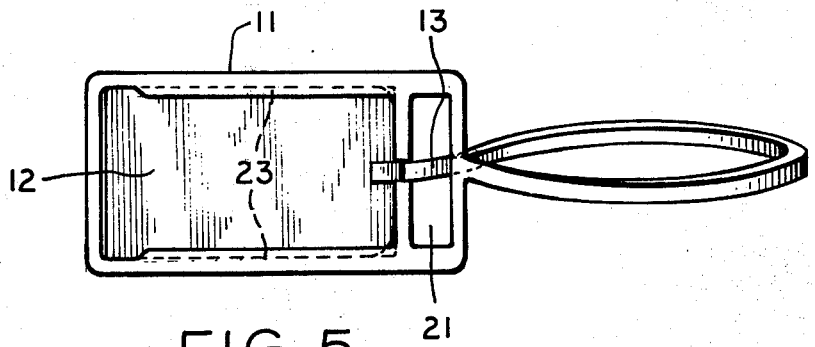
FIG. 5 is also a perspective view showing the plate fully inserted in the channelled sidewalls of the case to close the case, whereby the strap is bent to form a loop for attachment of the tag to baggage handles.

The case 11 comprises a bottom wall 15, parallel sidewalls 16, a front end wall 17 and rear end wall 18, all walls being of equal height, forming a cavity capable of accommodating an identification label. Extending out from rear end wall 18 is ledge 20 in which is formed aperture 21 having a rectangular shape. The aperture 21 is dimensioned so that the length of the aperture is slightly larger than the width of the plate 12 in order to allow the plate 12 to enter into and be threaded through the aperture 21.

The inner surfaces of the case sidewalls 16 have formed therein slideways or channels 23, adapted and dimensioned to snugly and slidably confine the plate 12 upon its entry therein. The upper edges 24 of the sidewalls 16 are additionally formed with an entry slot or groove 25 immediately adjacent the front wall 17 to accept a front end part of the plate 12 and promote its entry into the channels 23. The upper edge 26 of the rear wall 18 is additionally formed with a centrally located notch 27 adapted to accept the strap 13 and guide its movement when the plate 12 is passed through the aperture 21.

The plate 12 which is sized and shaped to be received by and confined in the channels 23 of the case 11 is comprised of a front wall 28, sidewalls 29 and rear wall 30. The corners 31 of the rear wall 30 are preferably tapered or bevelled to assist the entry of the plate 12 into the channel 23 as it is slid into the case through entry grooves 25 in assembling the plate 12 to the case body 11.

The strap portion 13 is formed to connect the longitudinal wall 33 of the ledge 20 to the plate 12. In forming the strap 13, opposite ends of the strap are integrally molded with the case 11 and plate 12, one end of the strap 13 being attached centrally to the edge of the wall 30 and the other end to the upper face 34 of the plate 12. It has been determined that by molding the strap 13 to the upper face 34 of the plate 12 rather than to the edge of the rear wall 30 of the plate 12, the attachment is much more resistant to severance when the strap 13 is looped and secured to baggage and thereafter subjected to twisting or other such stresses.

In attaching the luggage tag 10 to a handle or other portion of an article of luggage, an identification label is placed in the case 11. The label is inserted so that its inscription can be seen through the bottom wall 15 of the case 11 if the baggage owner so desires. If the owner of the baggage demands or requires that the inscription of his name and address are not to be viewed through the tag, a bi-fold label may be provided and the owner's inscription is sealed within the folds of the label, thereby concealing the owner's identity.

The tag 10 is placed under the handle or other attachment means of the luggage (not shown) at a point about midway of the strap. The plate 12 is inserted in the aperture 21 from the bottom side of the ledge 20 of the case 11. As the plate 12 is passed through the aperture 21, the strap 13, which is attached to the plate 12, is caused to be bent and forms a temporary tight loop around the baggage handle as the plate 12 is drawn past the case 11. The plate 12 is then flexed, and the rear wall 30 of the plate 12 is inserted in the entry slot of the sidewalls 16 and pushed into and received by the channels 23. Upon its reception in the channels 23, the plate 12 is slid in the channels until its passage is stopped by the rear wall 18, indicating to the tagger that the tag is now in its final looped and fastened position and is permanently attached to the baggage handle. The plate 12 is so dimensioned that when it is stopped by the rear wall 18, it is fully disposed in case 11 and totally closes the case to confine the identification label therein. As the walls of case 11 are of equal height when plate 12 is fully disposed in the sidewall channels 23, the plate 12 is positioned below the front wall 17 of the case 11, as the channels 23 are located at a point below the top surface of the front wall 17. Thus, after the plate 12 is inserted into the channelled sidewalls 23 throughout its full length, any reverse sliding movement of the plate is prevented by the presence of the higher front wall surface, and thus the plate 12 is locked in and confined in the channelled sidewalls and accidental longitudinal displacement of the plate is thereby prevented, the channels themselves operating to retard any upward movement of the plate 12. As the plate 12 is fully displaced in the case sidewall channels 23 and permanently confined therein, the strap loop is loosened and provides a permanent looped attachment of the strap 13 to the baggage.

I claim:

1. A luggage tag comprising an elongated strap for fastening the tag to luggage, the strap having attached at one end a case body adapted to receive an identification label and at the other end a plate adapted for closing the case and retaining the label therein, the case, plate and strap being integrally formed as a unitary blank from a synthetic plastic material, the case having sidewalls, front end walls and rear end walls of substantially equal height, the sidewalls being formed with internal channels and adapted to slidably receive and thereafter confine the movement of the plate upwardly from the case, the sidewalls having upper edges provided with grooves to assist the entry of the plate into the sidewall channels, the plate when fully deployed in the channels being retained therein by the front and rear walls against longitudinal displacement from the channels, the rear wall having a ledge extending therefrom having an aperture, the aperture being dimensioned to allow the passage of the plate therethrough, the strap being bent to form a loop as the plate is passed through the aperture and slid inside the channels, thereby closing the case when fully deployed therein and providing a strap loop for fastening the tag to a piece of luggage.

2. The tag of claim 1 wherein the front wall of the plate has tapered corners.

3. The tag of claim 1 wherein the strap is attached to a face portion of the plate.

4. The tag of claim 1 wherein the case is adapted to receive a bi-folded identification label.

* * * * *